US009108793B2

(12) United States Patent
Northrup

(10) Patent No.: US 9,108,793 B2
(45) Date of Patent: Aug. 18, 2015

(54) ICE CREAM CONTAINER AND METHOD OF MANUFACTURING SAME

(71) Applicant: Rock-Tenn Shared Services, LLC, Norcross, GA (US)

(72) Inventor: David W. Northrup, Johns Creek, GA (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 0 days.

(21) Appl. No.: 14/277,991

(22) Filed: May 15, 2014

(65) Prior Publication Data

US 2014/0339294 A1 Nov. 20, 2014

Related U.S. Application Data

(60) Provisional application No. 61/823,643, filed on May 15, 2013.

(51) Int. Cl.
*B65D 85/78* (2006.01)
*B65D 5/66* (2006.01)
(Continued)

(52) U.S. Cl.
CPC ..... *B65D 85/78* (2013.01); *B65D 5/243* (2013.01); *B65D 5/246* (2013.01); *B65D 5/28* (2013.01); *B65D 5/546* (2013.01); *B65D 5/64* (2013.01); *B65D 5/6682* (2013.01); *B65D 5/2047* (2013.01); *B65D 5/244* (2013.01); *B65D 5/247* (2013.01); *B65D 5/68* (2013.01)

(58) Field of Classification Search
CPC ..... B65D 5/2047; B65D 5/244; B65D 5/247; B65D 5/68
USPC ..... 229/905, 902, 174, 177, 192
See application file for complete search history.

(56) References Cited

U.S. PATENT DOCUMENTS 382,559 A 5/1888 Schmidt
613,520 A * 11/1898 Keys ..... 229/152
(Continued)

FOREIGN PATENT DOCUMENTS

DE 1266211 4/1968
DE 29706783 10/1997
(Continued)

OTHER PUBLICATIONS

"How a Folding Carton is Made", retrieved from the internet at http://www.paperbox.org/Portals/0/Templates/How%20to%20Make%20a%20Folding%20Carton.pdf, at least as early as May 12, 2014, 16 pages.
(Continued)

*Primary Examiner* — Christopher Demeree
(74) *Attorney, Agent, or Firm* — Kilpatrick Townsend & Stockton LLP

(57) ABSTRACT

Embodiments of the present invention provide cartons that they are designed and shaped to hold product, such as ice cream, that are made from a single, one-piece blank. The one-piece blank can be folded by the food product manufacturer on-site to create a container or carton, without having to be shipped in a pre-glued configuration. The cartons generally do not require polyethylene in order to maintain their shape. Some embodiments are designed so as to have a slight outward taper of the left and right side walls and the back wall, which provides a pleasing shape to consumers, potentially increasing marketing opportunities and sales.

18 Claims, 12 Drawing Sheets

(51) Int. Cl.

| | |
|---|---|
| ***B65D 5/28*** | (2006.01) |
| ***B65D 5/54*** | (2006.01) |
| ***B65D 5/64*** | (2006.01) |
| *B65D 5/24* | (2006.01) |
| *B65D 5/20* | (2006.01) |
| *B65D 5/68* | (2006.01) |

(56) References Cited

U.S. PATENT DOCUMENTS

| | | | | | |
|---|---|---|---|---|---|
| 1,058,408 | A | * | 4/1913 | Chase | 229/170 |
| 1,480,827 | A | | 1/1924 | McColl | |
| 2,252,779 | A | | 8/1941 | Moore | |
| 2,443,431 | A | | 6/1948 | Ringler | |
| 2,505,442 | A | | 4/1950 | Thomas | |
| RE23,266 | E | | 9/1950 | Thomas | |
| 2,544,565 | A | | 3/1951 | Phillips | |
| 2,731,190 | A | | 1/1956 | Farrell | |
| 2,785,845 | A | | 3/1957 | Stenger | |
| 3,008,626 | A | * | 11/1961 | Lawrence | 229/150 |
| 3,058,645 | A | | 10/1962 | Luterick | |
| 3,078,171 | A | | 2/1963 | Skowronski | |
| 3,146,933 | A | | 9/1964 | Moore | |
| 3,601,305 | A | | 8/1971 | Benzon-Petersen | |
| 3,735,916 | A | | 5/1973 | Buttery | |
| 3,833,165 | A | | 9/1974 | Hoiles | |
| 4,526,563 | A | | 7/1985 | Froom | |
| 4,687,130 | A | | 8/1987 | Beeler | |
| 4,872,609 | A | | 10/1989 | DePaul | |
| 5,160,082 | A | | 11/1992 | McCormick et al. | |
| 5,409,160 | A | | 4/1995 | DeMay | |
| 5,411,204 | A | * | 5/1995 | DeMay | 229/114 |
| 5,588,584 | A | | 12/1996 | DeMay | |
| 5,653,384 | A | | 8/1997 | Shaikh | |
| 5,853,121 | A | * | 12/1998 | Francisco | 229/188 |
| 2002/0036230 | A1 | | 3/2002 | Chevalier et al. | |
| 2004/0238535 | A1 | | 12/2004 | Mast | |
| 2007/0017964 | A1 | | 1/2007 | Kamolsuwan | |

FOREIGN PATENT DOCUMENTS

| | | |
|---|---|---|
| GB | 1100688 | 1/1968 |
| WO | 9002690 | 3/1990 |

OTHER PUBLICATIONS

European Application No. 14168517.2, Extended European Search Report mailed Sep. 25, 2014, 6 pages.

* cited by examiner

ICE CREAM CONTAINER AND METHOD OF MANUFACTURING SAME

CROSS REFERENCE TO RELATED APPLICATIONS

This application claims the benefit of U.S. Provisional Application Ser. No. 61/823,643, filed May 15, 2013, titled "Ice Cream Container and Method of Manufacturing Same," the entire contents of which are hereby incorporated by reference.

FIELD OF THE DISCLOSURE

Embodiments of the present disclosure relate generally to cartons and to blanks for forming cartons. The cartons are designed to be formed from a one-piece blank that forms both the body of the carton, as well as the lid of the carton.

BACKGROUND

Packaging for ice cream has evolved over the years. Years ago, ice cream was packaged in a half gallon size lock-end style carton that was wax coated both inside and outside the carton. The wax, which was typically a cold wax, helped protect the paperboard carton from the moisture of the ice cream itself, as well as the freezer environment. As printing technology progressed, a hot wax replaced the cold wax and dried as a clear coating that enhanced the appearance of the carton and its graphics. As technology continued to evolve, hot wax was replaced with a polyethylene coating on the inside of the carton and a varnish coating on the outside, which helped protect the carton from the ice cream and the freezer environment.

Subsequently, companies began using ice cream cartons with a wax application on the inside surface of the paperboard during manufacture of the board itself. The application, known as mill waxing, provided structural stability to the inside surface of the carton and combined with a varnish coating on the outside surface as an alternative to the polyethylene coating.

Over time, a glued-end hooded carton (sometimes referred to as a "brick" carton) replaced the lock-end cartons that had traditionally been used. Brick cartons are typically glued before they are shipped to the supplier that fills them with ice cream. Moreover, round and non-round canister type ice cream cartons (sometimes referred to as "scround" or "squround") were introduced. The scround containers are multi-piece cartons that typically consist of four pieces—a bottom piece, a sidewall, a lid, and a lid rim—that are heat sealed together using a polyethylene coating. Both sides of the canisters are coated with polyethylene to bond the various pieces together and to also serve as a moisture barrier.

In the past, scround cartons were typically used to package premium or higher end brands of ice cream, including those with higher butterfat content. Over time, less premium brands have entered the canister market and the manufacturers of the high butterfat products have reduced the fat content, leveling the field.

There is a desire to provide improved containers for holding ice cream and other materials that is generally resistant to leaks, but that is manufactured using fewer pieces and materials. There is also a desire to provide improved containers that can hold their shape without being coated with polyethylene. This can provide an enhanced environmental benefit. It is also desirable to provide improved containers from a blank that is one-piece and can provide the container body, as well as the container lid, while still providing an attractive package that is pleasing to consumer expectations.

BRIEF SUMMARY

Embodiments of the present disclosure relate generally to cartons and to blanks for forming cartons. The cartons are designed to be formed from a one-piece blank that forms both the body of the carton, as well as the lid of the carton. The blanks provided in the disclosure are designed to be folded and glued prior to food product being packed therein. They can contain a food product without leaking, and without requiring a polyethylene coating for structural integrity.

DETAILED DESCRIPTION

Packaging manufacturers and end users have increasingly become conscious of the impact that certain packaging has on the environment. It has been desirable to provide attractive packaging that uses less material and more environmentally-friendly compounds and chemicals. One of the advantages of the various cartons described herein is that they are designed and shaped so that they do not require polyethylene in order to maintain their shape. Some embodiments are designed so as to have a slight outward taper of the left and right side walls and the back wall, which provides a pleasing shape to consumers, potentially increasing sales. Another advantage of certain containers described herein is that they provide an integral, one-piece blank that can be folded by the food product manufacturer on-site to create a container, without having to be shipped in a pre-glued configuration.

Figure 1:
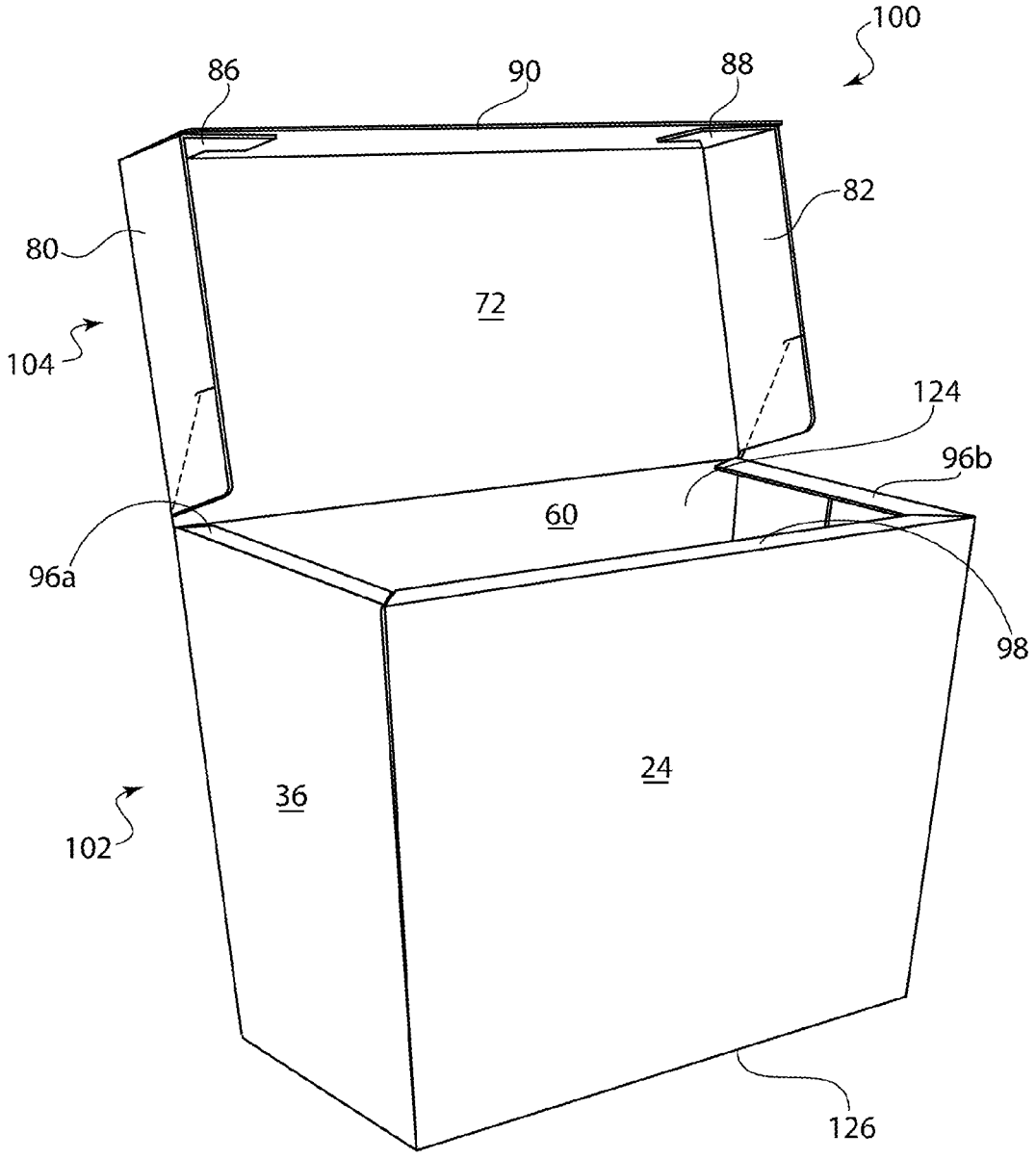
FIG. 1 shows a side perspective view of one embodiment of a carton with the lid in an open position.
Figure 2:
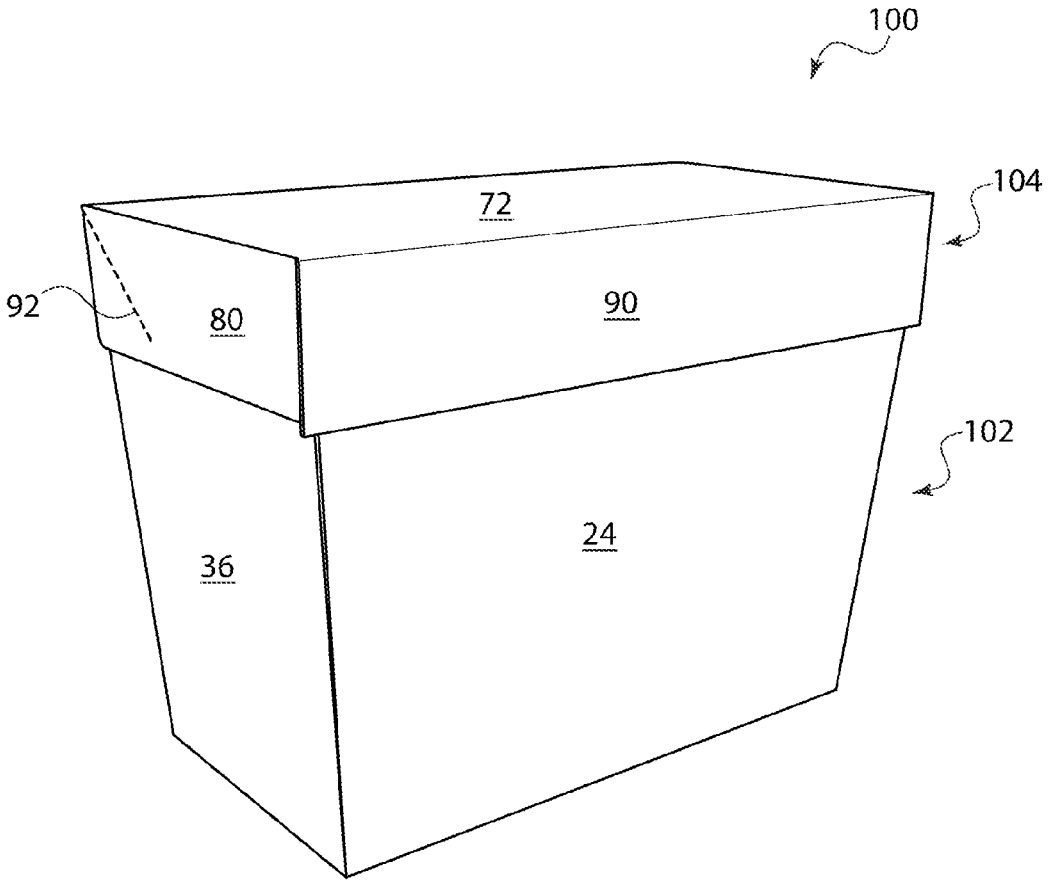
FIG. 2 shows the carton of FIG. 1 with the lid in a closed position.

As shown in FIGS. 1 and 2, there is provided an innovative carton 100 for ice cream. The carton 100 is formed as a one-piece design, having a body 102 with an integrated lid 104. Some embodiments of the carton 100 use mill wax as a coating to protect the carton 100 against moisture from the inside and provide enhanced coating on the outside. In this manner, the disclosed carton maintains an enhanced or "higher end" feel offered by the scround design and now demanded by consumers, while eliminating the need for multiple pieces and plastic. In addition, use of a one-piece design streamlines the manufacturing process and reduces costs.

Figure 3:
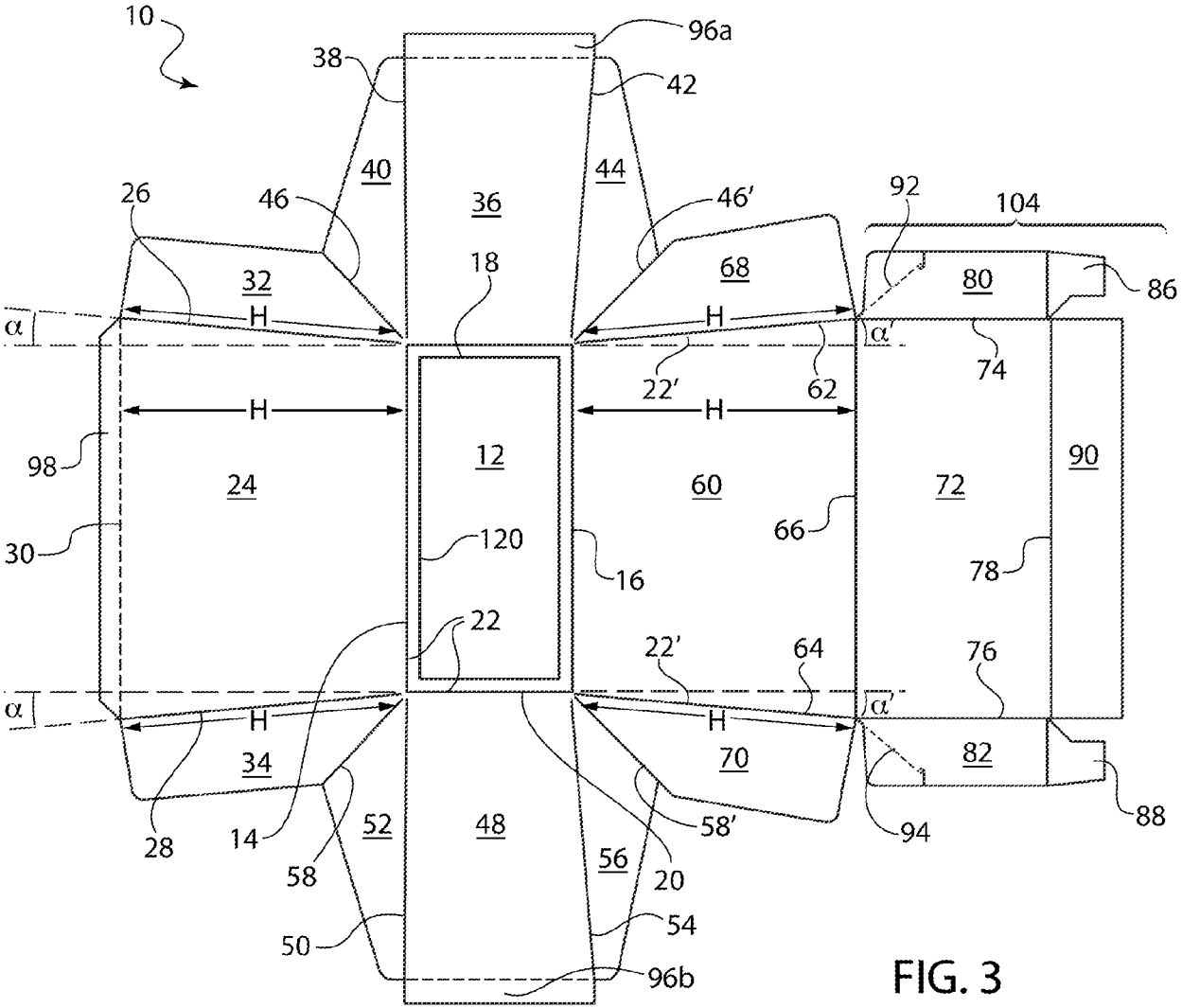
FIG. 3 shows a top plan view of one embodiment of a one-piece blank that may be used to form a carton.
Figure 4:
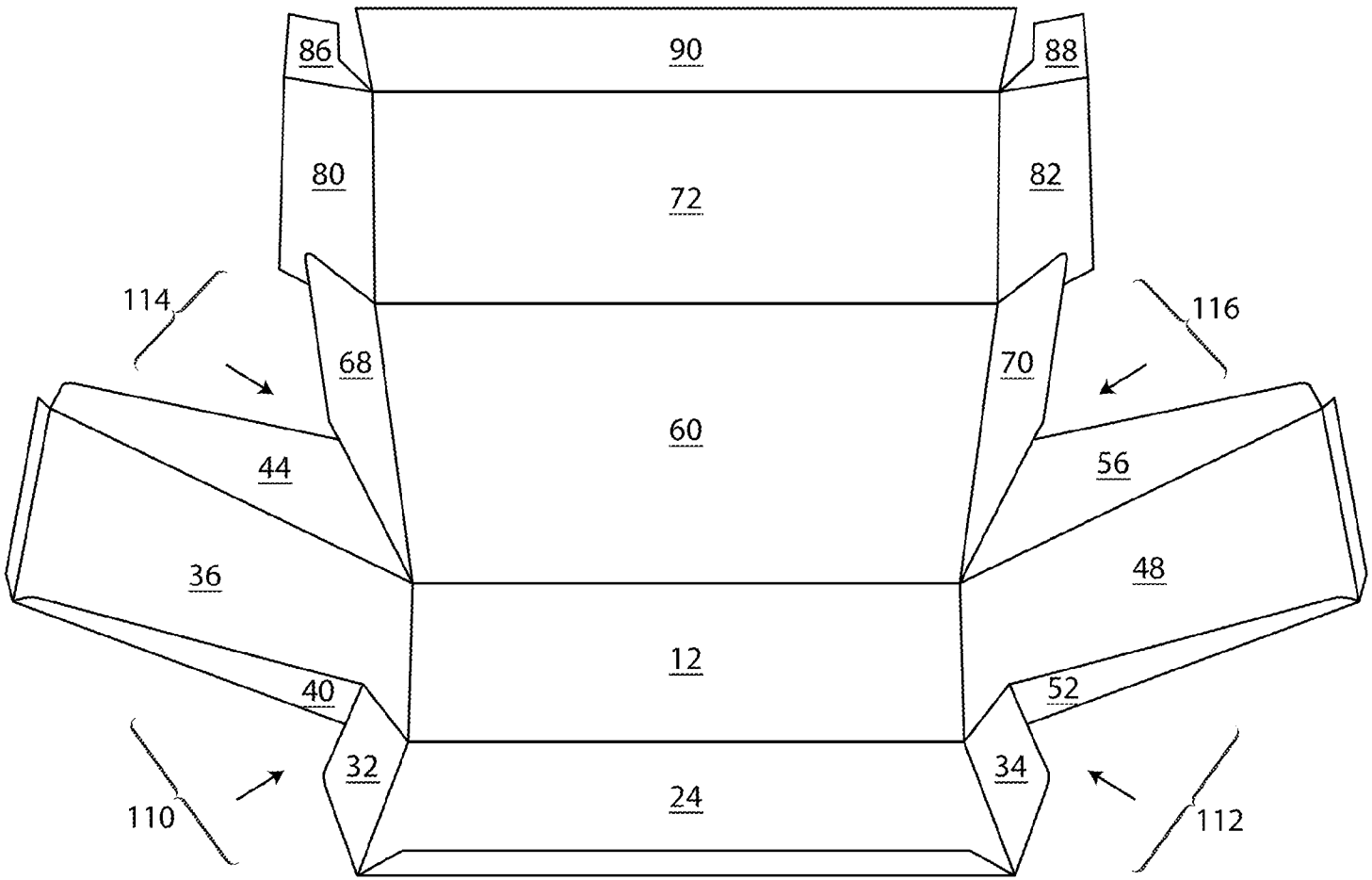
FIG. 4 shows a perspective view of one embodiment of a folding configuration of the blank of FIG. 3.
Figure 5:
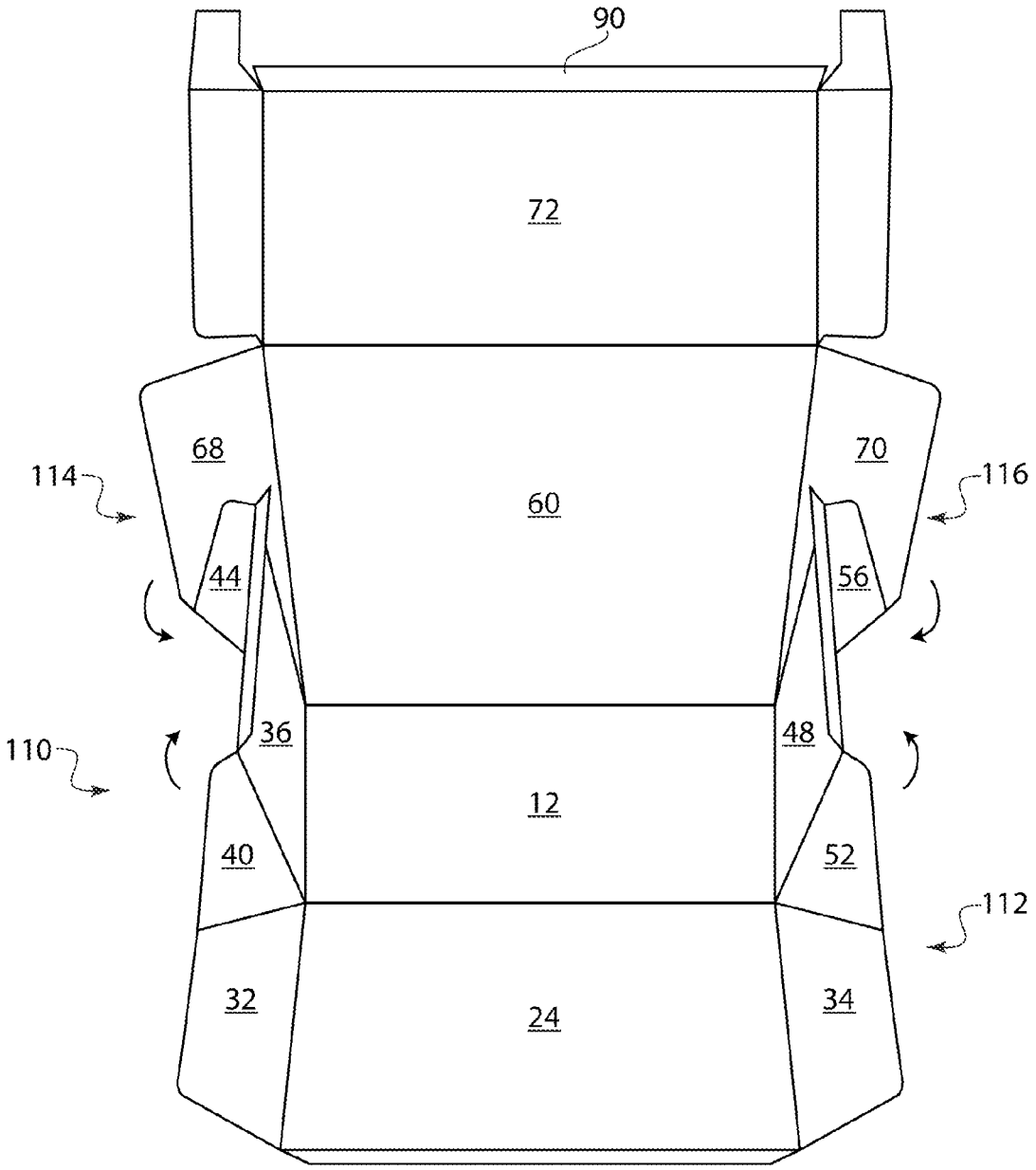
FIG. 5 shows a perspective view of an alternate embodiment of a folding configuration of the blank of FIG. 3.
Figure 6:
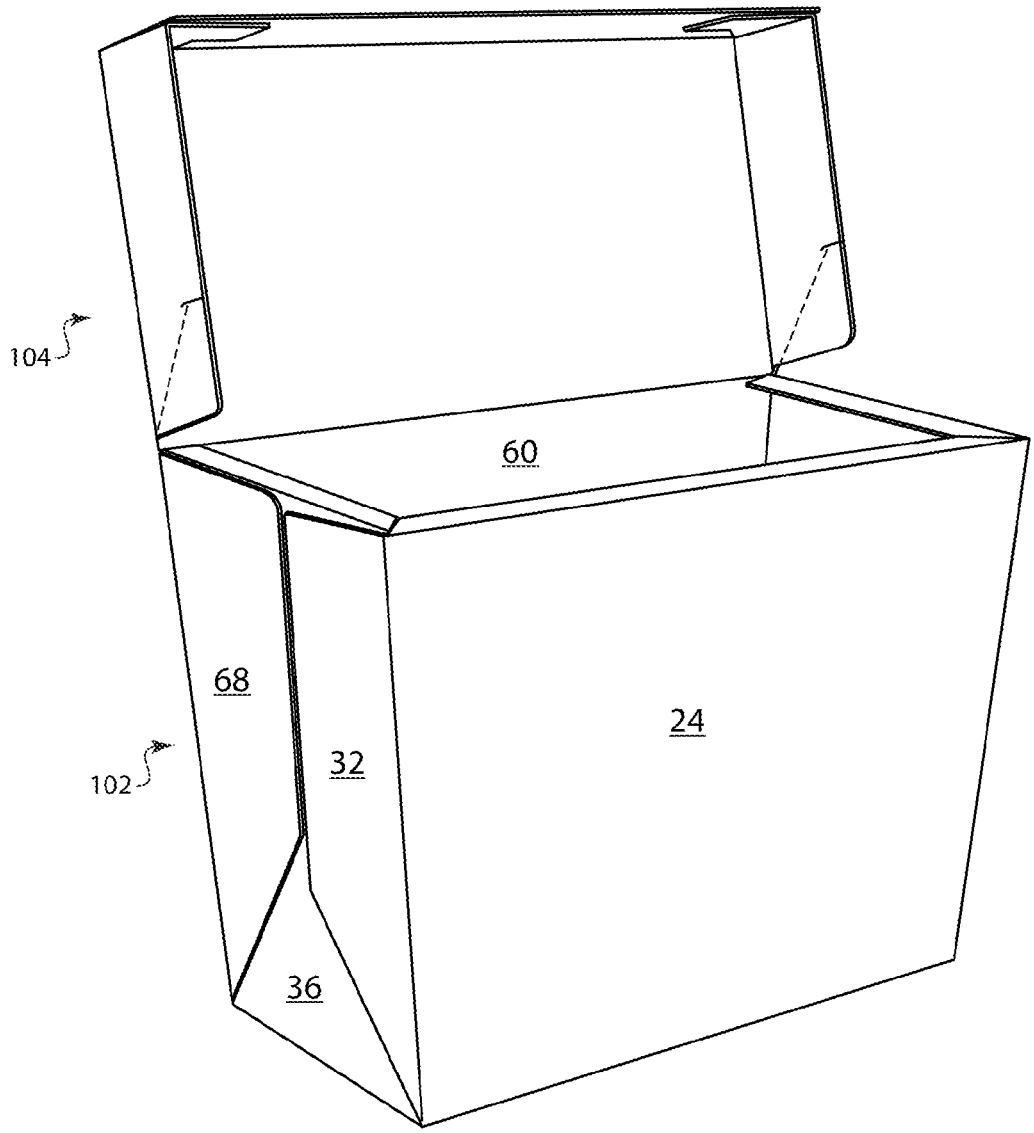
FIG. 6 shows a side perspective view of a carton folded according to the configuration of FIG. 5, with the lid in an open position.

As shown in FIG. 3, the blank from which the carton is erected is a one-piece blank 10. This means that the carton body and the carton lid are formed from the same one-piece of paperboard or fiberboard or whatever material is used to form the carton. As shown in FIGS. 4 and 5 (which illustrate optional folding configurations for the blank of FIG. 3), when folded, the blank 10 forms four gussets 110, 112, 114, 116, each gusset being formed by two cooperating gusset panels. Each gusset collapses against itself during erecting to provide an enhanced seal around the sides of the finished carton. In one embodiment, the gusset panels may be folded to the inside of the carton, as illustrated in FIG. 4. This option can create a clean side wall panel for graphics on the outside, as shown in FIGS. 1 and 2. In another embodiment, the gusset panels may be folded to the outside of the carton, as illustrated in FIG. 5. This option can create a side wall panel with flaps (and a smooth inner surface), as shown in FIG. 6. In either option, the gussets generally form webbed corners, that cause the container to be more resistant top leaks than the corners used with traditional brick-style cartons.

Figure 7:
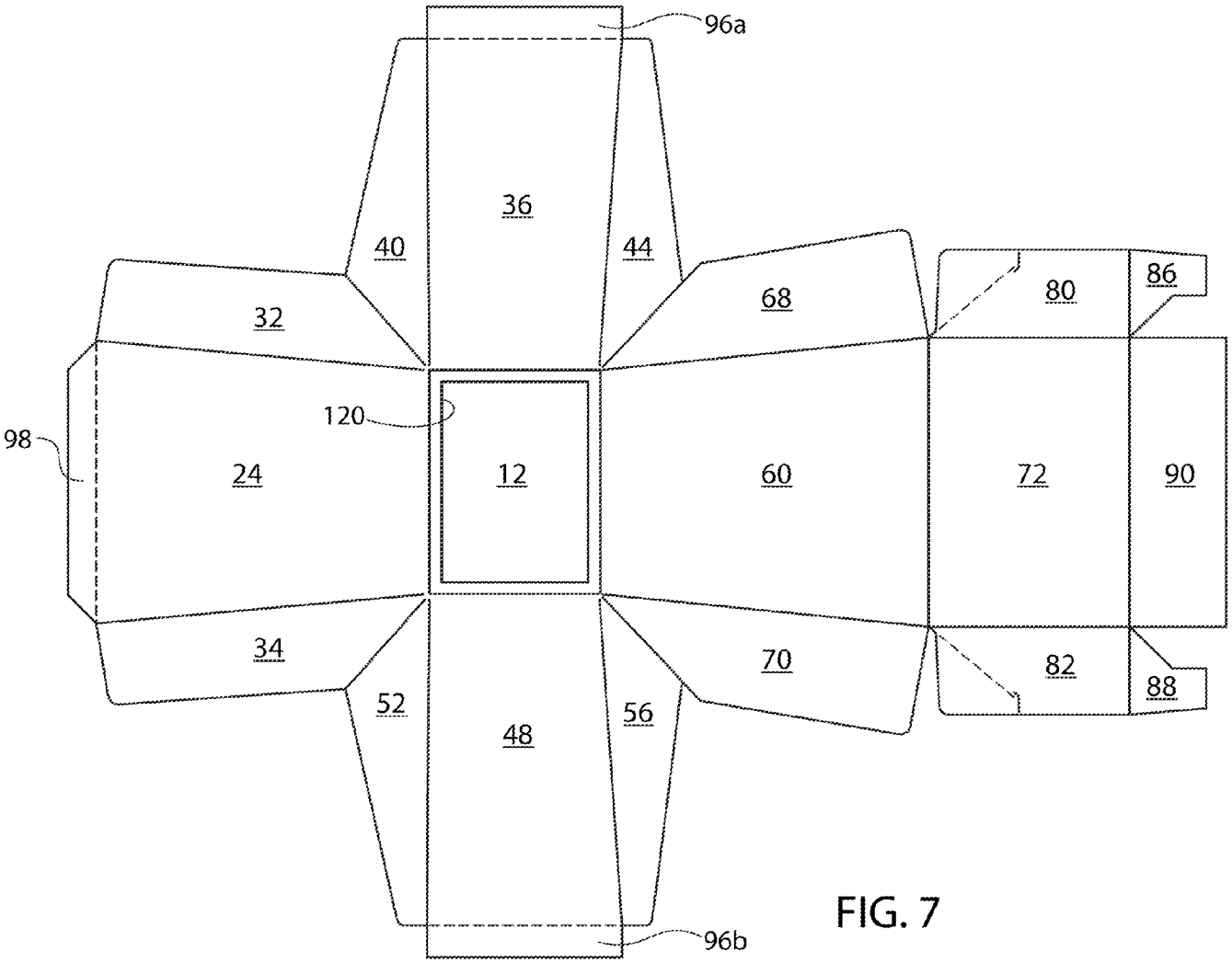
FIG. 7 shows a top plan view of an alternate embodiment of a one-piece blank that may be used to form a carton having a square-like shape.

Referring now to more specific features of the carton blank 10, FIG. 3 shows one embodiment of a carton blank 10 that forms a generally rectangularly-shaped carton. The carton formed when this blank is assembled in shown in FIGS. 1-2 and 6. FIG. 7 shows an alternate embodiment of a carton blank that forms a generally square-shaped carton. The carton formed when this blank is assembled in shown in FIGS. 8-10. The primary distinction between the cartons formed by the blanks of FIGS. 3 and 7 is the shape of the base panel and its associated panels. However, for the sake of convenience, like reference numerals will be used to reference like-positioned panels, regardless of their shape. Additionally, although two potential blank (and carton) shapes are shown in FIGS. 3 and 7, it should be understood that further shapes are possible and considered within the scope of this disclosure.

As shown in FIG. 3, the container blank 10 has a base panel 12. Base panel 12 has a front edge portion 14, a rear edge portion 16, a left side edge portion 18, and a right side edge portion 20. These portions are defined by crease lines 22, which are generally pre-formed in the blank to guide the folding/assembly process. Extending from the front edge portion 14 is a front wall panel 24. The front wall panel 24 has a left side 26, a right side 28, and an upper side 30. As illustrated, in one embodiment, the left side 26 and the right side 28 of the front wall panel 24 may form an outward taper from the crease line 22 formed between the base panel 12 and the front wall panel 24. This is illustrated by angle $\alpha$. This taper creates a visual upward and outward taper from the base of the carton to the top of the carton, once assembled, as shown in FIG. 1.

Foldably connected to the left side 26 of the front wall panel 24 is a first front gusset panel 32. Foldably connected to the right side 28 of the front wall panel 24 is a second front gusset panel 34. The front wall panel 24 has a height H and the gusset panels 32, 34 have a similar height H. This allows the panels to extend the height of the carton, once it is formed, adding structural integrity and helping to prevent leaks.

Foldably connected to the left side edge portion 18 of the base panel 12 is a left side panel 36. The left side panel 36 is associated with two gusset panels. More specifically, the left side panel 36 has a forward side 38 that is foldably connected to a first forward side gusset panel 40. The left side panel 36 has a rear side 42 that is foldably connected to a first rear side gusset panel 44. As shown, the first front gusset panel 32 and the first forward side gusset panel 40 are joined by an angled crease line 46. (In use, the two panels will overlap one another, as described in more detail below.)

Foldably connected to the right side edge portion 20 of the base panel 12 is a right side panel 48. The right side panel 48 is also associated with two gusset panels. More specifically, the right side panel 48 has a forward side 50 that is foldably connected to a second forward side gusset panel 52. The right side panel 48 has a rear side 54 that is foldably connected to a second rear side gusset panel 56. As shown, the second front gusset panel 34 and the second forward side gusset panel 52 are joined by an angled crease line 58. (In use, the two panels will overlap one another, as described in more detail below.)

Next, foldably connected to the rear edge portion 16 of the base panel 12 is a back wall panel 60. Back wall panel 60 has a left side 62, a right side 64, and an upper side 66. As illustrated, in one embodiment, the left side 62 and the right side 64 of the back wall panel 60 may form an outward taper from the crease line 22' formed between the base panel 12 and the back wall panel 60. This is illustrated by angle $\alpha'$. This taper creates a visual upward and outward taper from the base of the carton to the top of the carton, when viewed from the rear and once assembled.

Foldably connected to the left side 62 of the back wall panel 60 is a first rear gusset panel 68. Foldably connected to the right side 64 of the back wall panel 60 is a second rear gusset panel 70. The back wall panel 60 has a height H and the gusset panels 68, 70 have a similar height H. This allows them to extend the height of the carton, once it is formed, adding structural integrity and helping to prevent leaks. As shown, the first rear side gusset panel 44 and the first rear gusset panel 68 are joined by an angled crease line 46'; the second rear side gusset panel 56 and the second rear gusset panel 70 are also joined by an angled crease line 58'.

Foldably connected to the back wall panel 60 is a lid panel 72. The lid panel has a left side 74, a right side 76 and a front edge portion 78. Foldably connected to the left side 74 is a left side flap 80, and foldably connected to the right side 76 is a right side flap 82. These flaps 80, 82 form the sides of the lid. They are generally secured in place during folding via first and second wrap/glue flaps 86, 88. Foldably connected to the front edge portion 78 of the lid panel 72 is a lid flap 90. In use, the side flap 80, 82 are folded down, and the wrap/glue flaps 86, 88 can wrap around and secure the side flaps 80, 82 to the lid flap 90. Alternatively and as shown in FIGS. 1, 6, 8, and 10 the wrap/glue flaps 86, 88 may fold and wrap to the inside of the lid flap 90 and be glued to an inner surface thereof, in order to provide a smooth lid flap. Once folded and glued, these panels collectively form a lid 104 for the carton body 102.

Figure 8:
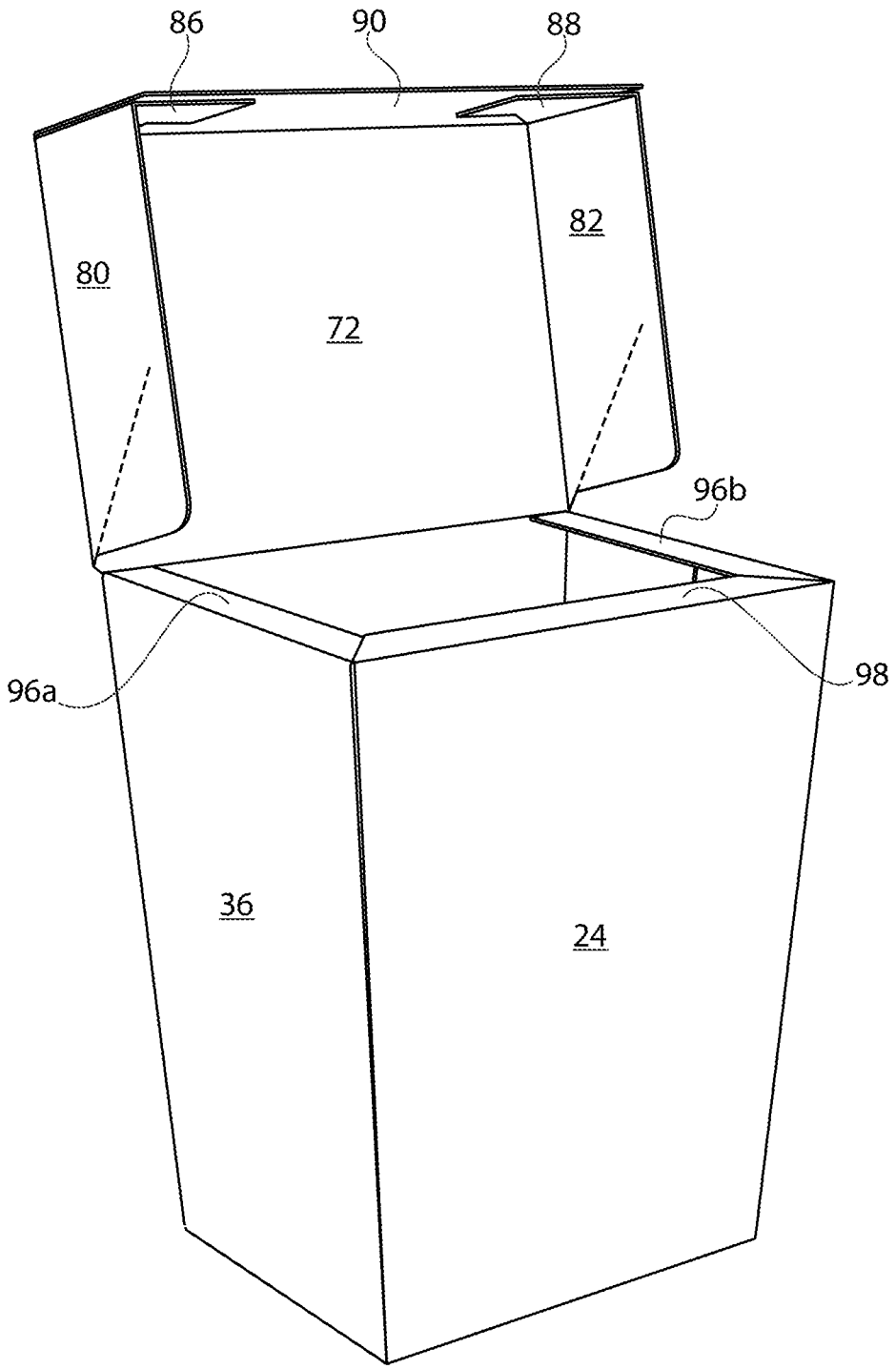
FIG. 8 shows a side perspective view of a carton formed from the blank of FIG. 7, folded with the gusset panels positioned to the inside of the side panel, with the lid in an open position.
Figure 9:
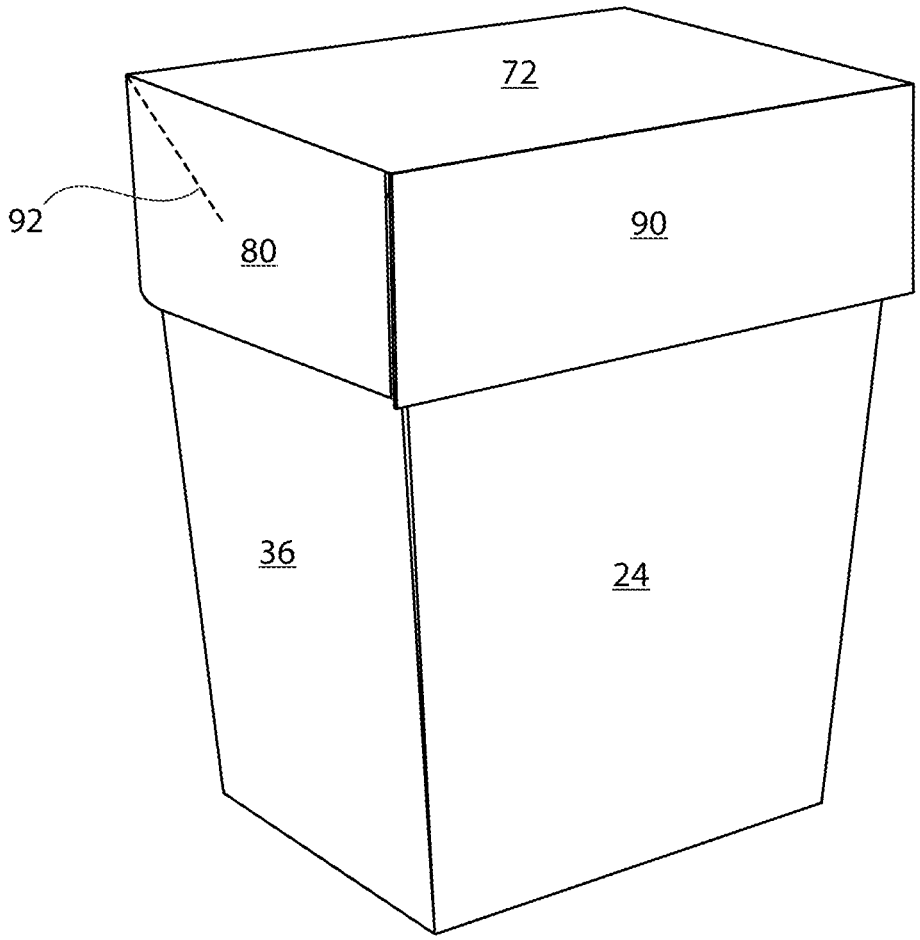
FIG. 9 shows the carton of FIG. 8 with the lid in a closed position.
Figure 10:
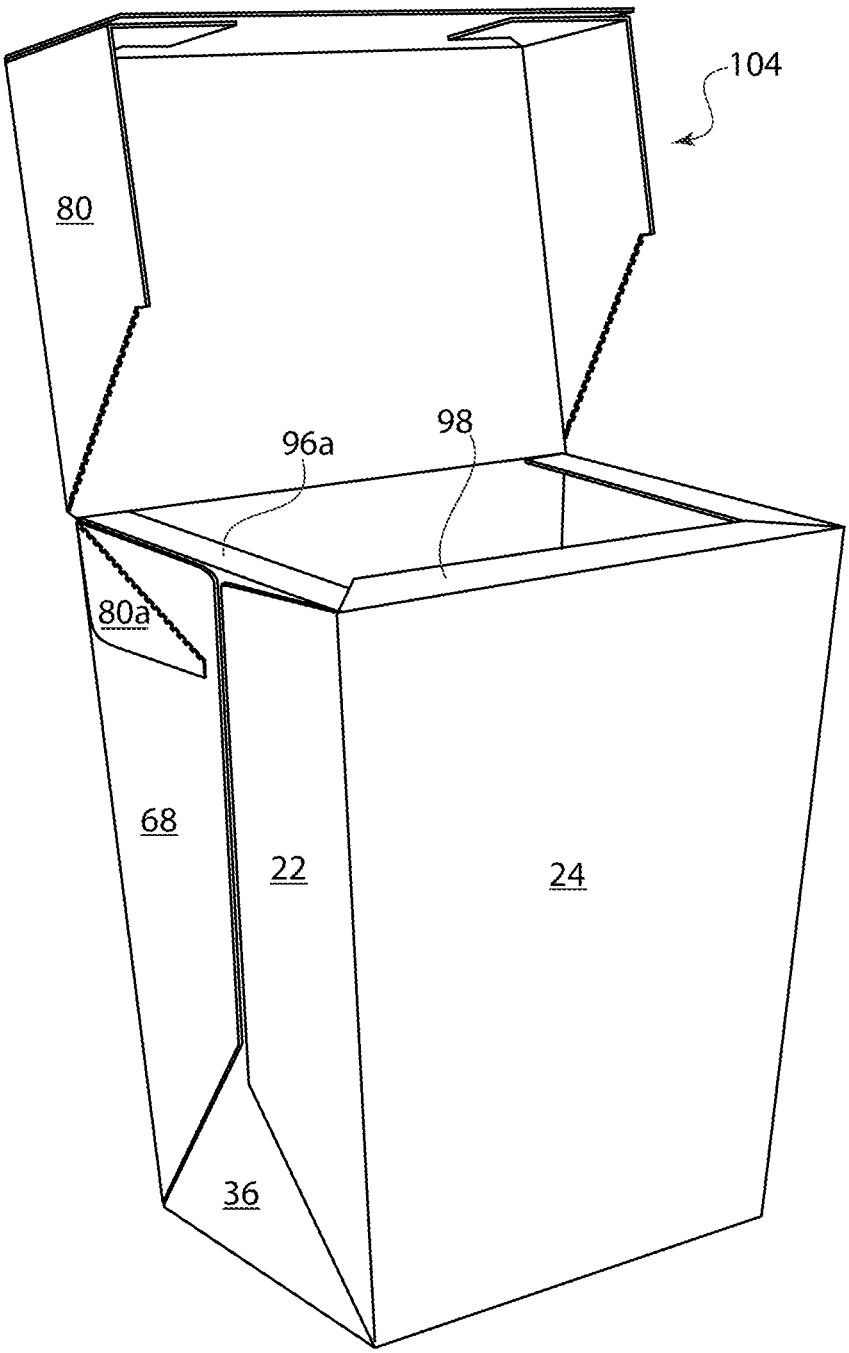
FIG. 10 shows a side perspective view of a carton formed from the blank of FIG. 7, folded with the gusset panels positioned to the outside of the side panel, with the lid in an open position. In this carton, the lid has been sealed and then opened, evidenced by a perforated portion of the side flap that has been torn away from the lid.

Side flaps 80, 82 also have perforated portions 92, 94. These perforated portions 92, 94 assist in opening the sealed lid 104 in use. Perforated portions 92, 94 are generally diagonal with respect to the side flaps 80, 82 which allows their angled tearing for opening of an assembled carton 100. FIGS. 1, 6, and 8 show the lid 104 in an open position, prior to the lid being glued or otherwise secured to close the carton. FIG. 10 shows an embodiment with the lid being opened after it has been glued or otherwise secured closed. The primary distinction shown in FIG. 10 is that the part 80*a* of each of the side flaps 80, 82 defined by perforations 92, 94 is caused to rip during opening of the carton, leaving part 80*a* glued to the carton body 102, and allowing the lid 104 open and re-open.

Each of the left side panel 36 and the right side panel 48 has an optional lip 96*a*, 96*b*. Optional lips 96*a-b* are foldable portions that can provide a support for holding the gusset panels in place. For example, they may be folded over the gusset panels and glued into place. Alternatively, optional lips 96*a-b* may create an inward guard that helps contain the contents of the carton 100 (e.g., if melting occurs, the lips 96*a-b* prevent over spillage or leakage). This is the embodiment shown in FIGS. 1, 6, 8, and 10. The front walls panel 24 is also shown as having an optional front lip 98. Front lip 98 may be folded over onto the front face of the front wall panel 24 to provide a securing location for the lid flap 90. Alternatively, front lip 98 may create an inward guard that works in concert with optional lips 96*a-b* to prevent over spillage or leakage of the contents out of the carton. This is the embodiment shown in FIGS. 1, 6, 8, and 10.

The design of the disclosed carton is such that the carton is well-suited to run on an erecting machine without any pre-gluing. Traditional brick cartons must be pre-glued before being shipped to a supplier. Upon receipt of the pre-glued brick, the supplier would partially erect the brick carton by folding at least one of the sides along various fold lines, filling the container with ice cream, and then folding over the top end to close the carton. By contrast, the disclosed carton can be shipped in an unglued state, allowing the supplier to erect the blank in one step using a mandrel or other suitable machine to simply fold in the gussets, as opposed to assembling multiple pieces of scround or folding the various fold lines associated with a brick. The carton can then be filled with ice cream, and the hood can simply be folded to close the carton. In this way, the process of erecting the blank into the formed carton is simplified.

Referring specifically now to FIGS. 4 and 5, the folding process of the blank 10 is now described. One benefit of this blank and its configuration is that it can folded on-site at the product loading location (i.e., an ice cream plant) with a plunge former. (The term "plunge former" is generally used to refer to a machine that can fold a blank along pre-folded creaselines and that can add glue at desired points in the process.) For instance, the blank itself may be die cut (and printed and/or coated) at the carton manufacturing facility and shipped to the product loading location in a flat configuration. A flat blank may then be loaded into a plunge former, and the plunge former can cause the blank to fold along the pre-formed crease lines 22 (the folds that allow the panels to be foldably connected to one another). In a specific embodiment, folding pressure causes the front wall panel 24 to bend up from the base panel 12, the left and right side panels 36, 48 to bend up from the base panel 12, and the back wall panel 60 to bend up from the base panel 12. This bending action also causes the gusset panels 32, 34, 40, 44, 52, 56, 68, 70 to bend upwardly and away from the base panel 12.

In one embodiment, gusset panels 32 and 40 may be caused to fold onto one another a create a front left gusset portion 110. Gusset panels 34 and 52 may be caused to fold onto one another a create a front right gusset portion 112. Gusset panels 44 and 68 may be caused to fold onto one another a create a rear left gusset portion 114. Gusset panels 56 and 70 may be caused to fold onto one another a create a rear right gusset portion 116. As shown in FIG. 4 (with a completed folded carton shown in FIG. 1), gusset portions 110, 112, 114, and 116 may fold inwardly to create a clean side panel onto which graphics may be printed and viewed without interruption from seams. In the embodiment shown in FIG. 5 (with a completed folded carton shown in FIG. 6), gusset portions 110, 112, 114, and 116 may fold outwardly, with gusset panels 32 and 68 folding over gusset panels 40 and 44 on the left side, and with gusset panels 34 and 70 folding over gusset panels 52 and 56 on the right side. This embodiment may create a clean inner panel (which contacts the product contained in the carton) but a side panel that has seams created by edges of the outer (front and rear) gusset panels that have been wrapped over and glued to the inner (side) gusset panels. As shown in FIG. 6, the left side of the carton has gusset panels 32 and 68 wrapped over and sealed against gusset panels 44 and 44 and covering a portion of the side panel 36.

This forms the body 102 of the carton 100. The optional lips 96*a-b* and 98 may be folded at this point by the plunge former or they may be folded prior to sealing of the lid. The lid 104 may also be formed on the plunge former, but not sealed. To form the lid 104, the left side flap 80, the right side flap 82, and the lid flap 90 are folded down from the lid panel 72. These flaps are generally secured in place via the first and second wrap/glue flaps 86, 88. Wrap/glue flaps 86, 88 wrap around and secure the side flaps 80, 82 to the lid flap 90. These panels collectively form a lid 104 for the carton 100. The lid 104 is left unsealed at this point.

Once the body 102 of the carton 100 has been formed, it may be loaded with product using methods known in the art. Once loaded with product, the carton lid 104 may be sealed. The lid flap 90 of the lid 104 is generally sealed to the front wall panel 24. If provided, the lip 98 of the front wall panel 24 may be folded outwardly to cover a small portion of the panel 24, and may have the lid flap 90 secured thereto. This can help prevent damaging of any graphics on the front wall panel 24 during opening of the carton 100.

The disclosed carton may include any suitable mechanism for sealing the lid 104 of the carton 100. In some embodiments, the lid is sealed with an adhesive. In some embodiments, the lid closure mechanism may include a feature that produces an audible clicking sound when the hood of the carton is closed.

As shown in FIG. 1, in some embodiments of the carton 100 once formed, the front wall 24 and the sides 36, 48 have an upward enlarging taper so that the width of the upper portion 124 of the carton is greater than the width of the lower portion 126 of the carton. In some embodiments, including an adequate outward taper allows the formed cartons to nest one within another and be de-nested for use.

Figure 12:
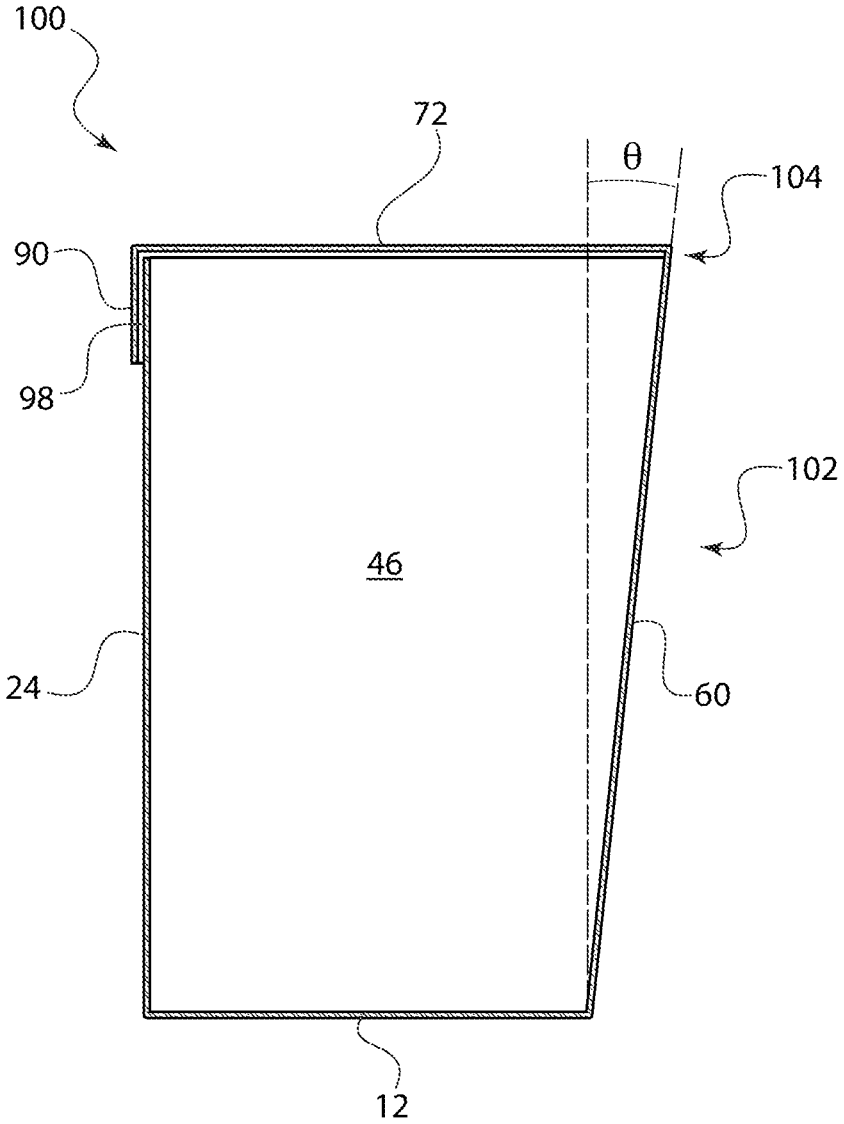
FIG. 12 shows a side plan view of a carton having a lid sealed is a closed position, showing a back wall with an outward angle relative to the base panel and a front wall being generally perpendicular to the base panel.

In some embodiments, either the rear (back wall panel 60) or the front (front wall panel 24) of the carton 100 has a slight (or more than slight) angle relative to vertical. Once example of this configuration is illustrated by FIG. 12, shown by angle θ. This allows the one-piece lid 104 to form a tight seal with the tapered design of the carton 100. Angling one of the front or the rear walls of the carton 100 can make it easier to raise and lower the lid 104 and to maintain a closed connection between the lid 104 and the rest of the tapered carton body 102.

In a particular embodiment, slightly outwardly angling the back wall 60 of the carton while keeping the front wall 24 of the carton generally square or perpendicular to the bottom panel 12 may help keep the pivot point of the lid 104 in the same plane as the lid panel 72. This can help provide adequate clearance for the lid flap 90 when the lid 104 is closed, giving it a flat place to which to secure.

In certain embodiments, the base panel 12 of the carton 100 may also include a slightly embossed portion 120. This may help strengthen the carton, elevate the carton, and/or reduce the contact area of the carton to the freezer belts. The lid panel 72 may further include a slightly embossed top 122 to give enhanced features thereto. One example of a blank showing both panels 12, 72 being embossed is provided in FIG. 11.

Figure 11:
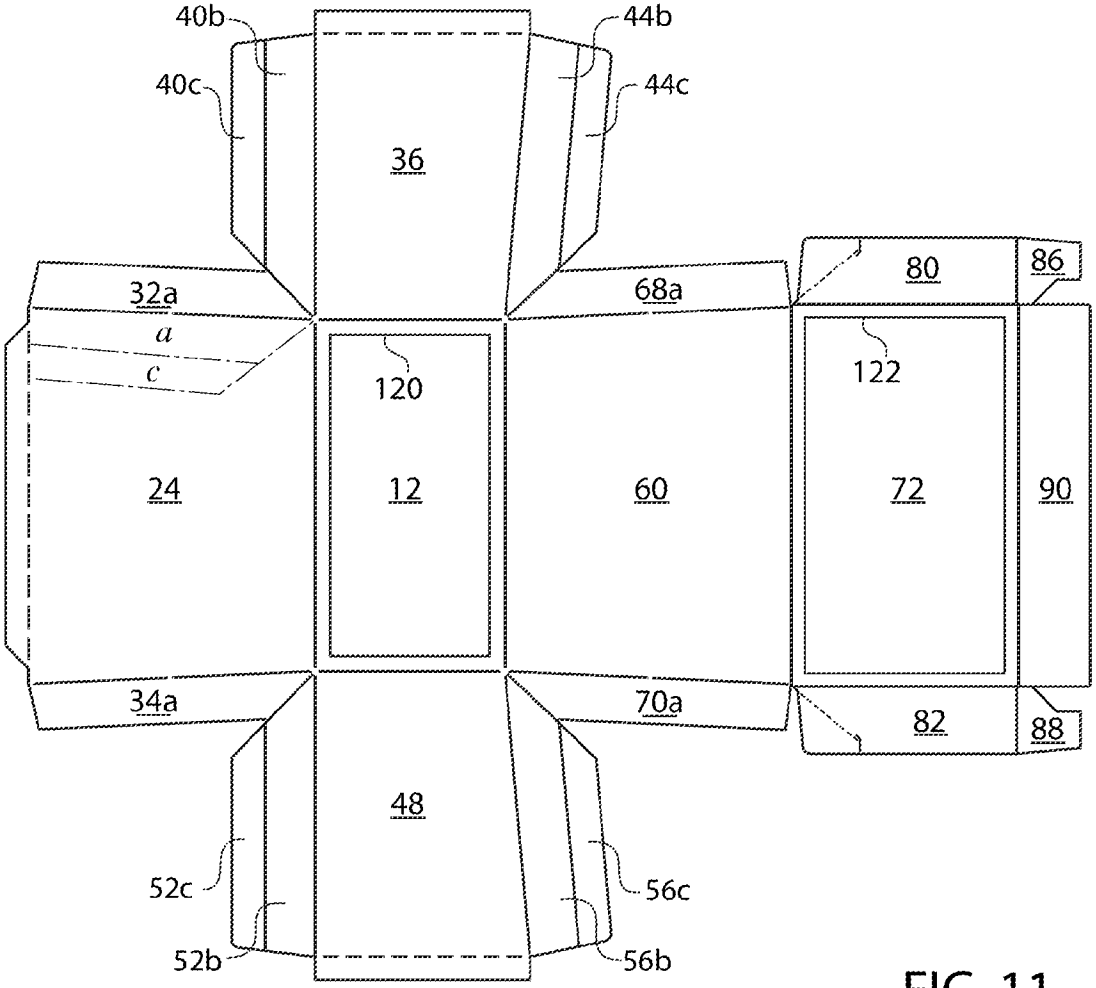
FIG. 11 shows a top plan view of an alternate embodiment of a one-piece blank that may be used to form a carton, having an embossed base panel and lid panel, and having an alternate gusset panel gluing configuration.

FIG. 11 also shows a blank having an alternate gusset folding and gluing configuration. As shown, the first forward side gusset panel 40 is divided into panels 40B and 40C, the first rear side gusset panel 44 is divided into panels 44B and 44C, the second forward side gusset panel 52 is divided into panels 52B and 52C, and the second rear side gusset panel 56 is divided into panels 56B and 56C. Each of the C panels extends away from the related B panel and away from a diagonal crease line in order to create a stand-alone gusset flap panel. Additionally, as compared to the shape of the gusset panels of FIG. 3, the gusset panels of FIG. 11 are slimmer, but they still maintain the height of its corresponding panel. This allows the potential use of less material, while still maintaining leak-resistant properties of the carton.

During folding of the blank of FIG. 11, the inside surface of the A panels (32A, 34A, 68A, 70A) is glued to a corresponding phantom line "a" on its adjacent panel (the front panel 24 for panels 32A and 34A and the back panel 60 for panels 68A and 70A). The outside surface of the A panels is glued to the outside surface of the B panels. The outside surface of the C panels is glued to the phantom "C" on the same adjacent panel. This create a desired gusset panel.

In some embodiments, the disclosed cartons do not include any polyethylene coating. The shape and design of the carton blank allows it to be structurally sound without requiring the polyethylene coating that is typical in many scround cartons. The disclosed carton also eliminates the use of plastic, including plastic lids and plastic lid rims. This can reduce material costs. This also renders the carton compostable, recyclable, and more sustainable.

Changes and modifications, additions and deletions may be made to the structures and methods recited above and shown in the drawings without departing from the scope or spirit of the invention and the following claims.

What is claimed is:

1. A carton blank, comprising:

(a) a base panel;

(b) a front panel foldably connected to a front edge portion of the base panel via a crease line;

(c) the front panel foldably connected to a first front gusset panel on a left side and a second front gusset panel on a right side;

(d) a left side panel foldably connected to a left side edge portion of the base panel via a crease line;

(e) the left side panel foldably connected to a first forward side gusset panel on a forward side and a first rear side gusset panel on a rear side;

(f) a right side panel foldably connected to a right side edge portion of the base panel via a crease line;

(g) the right side panel foldably connected to a second forward side gusset panel on a forward side and a second rear side gusset panel on a rear side;

(h) a back wall panel foldably connected to a rear edge portion of the base panel via a crease line;

(i) the back wall panel foldably connected to a first rear gusset panel on a left side and a second rear gusset panel on a right side;

(j) a lid panel foldably connected to an upper side of the back wall panel;

(k) a left side flap foldably connected to a left side of the lid panel;

(l) a right side flap foldably connected to a right side of the lid panel, further comprising first and second side wrap/glue panels foldably connected to the left and right side flaps;

(m) lid lip panel foldably connected to a front edge of the lid panel.

2. A carton blank, comprising:

(a) a base panel;

(b) a front panel foldably connected to a front edge portion of the base panel via a crease line;

(c) the front panel foldably connected to a first front gusset panel on a left side and a second front gusset panel on a right side;

(d) a left side panel foldably connected to a left side edge portion of the base panel via a crease line;

(e) the left side panel foldably connected to a first forward side gusset panel on a forward side and a first rear side gusset panel on a rear side;

(f) a right side panel foldably connected to a right side edge portion of the base panel via a crease line;

(g) the right side panel foldably connected to a second forward side gusset panel on a forward side and a second rear side gusset panel on a rear side;

(h) a back wall panel foldably connected to a rear edge portion of the base panel via a crease line;

(i) the back wall panel foldably connected to a first rear gusset panel on a left side and a second rear gusset panel on a right side;

(j) a lid panel foldably connected to an upper side of the back wall panel;

(k) a left side flap foldably connected to a left side of the lid panel;

(l) a right side flap foldably connected to a right side of the lid panel, wherein the left and right side flaps of the lid panel comprise a diagonal perforation; and (m) lid lip panel foldably connected to a front edge of the lid panel.

3. The carton blank of claim 2, wherein the first front gusset panel and the first forward side gusset panel are foldably connected along a diagonal crease line.

4. The carton blank of claim 2, wherein the second front gusset panel and the second forward side gusset panel are foldably connected along a diagonal crease line.

5. The carton blank of claim 2, wherein the first rear side gusset panel and the first rear gusset panel are foldably connected along a diagonal crease line.

6. The carton blank of claim 2, wherein the second rear gusset panel and the second rear gusset panel are foldably connected along a diagonal crease line.

7. The carton blank of claim 2, wherein each of the gusset panels has a height that is generally equivalent to its corresponding foldably connected panel.

8. The carton blank of claim 2, further comprising lip panels foldably connected at top edges of the left side panel, the right side panel, and the front wall panel.

9. The carton blank of claim 2, wherein the base panel comprises a recessed portion.

10. The carton blank of claim 2, wherein the lid panel comprises a recessed portion.

11. The carton blank of claim 2, wherein when folded, the front wall panel makes a generally perpendicular angle with the base panel and the back wall panel has a slightly outward angle from perpendicular with respect to the base panel.

12. The carton blank of claim 2, wherein the front wall panel and the back wall panel are tapered and provide an upward and outward taper from a base of the carton to a top of the carton once assembled.

13. A carton formed from a one-piece blank, comprising:

(a) a front wall, (b) a left side wall, (c) a right side wall;

(d) a back wall;

(e) a base; and (f) a lid comprising left and right side flaps that each comprise a diagonal perforation, wherein the left side wall is reinforced by a left-hand side gusset and wherein the right side wall is reinforced by a right-hand side gusset;

(g) the left hand side gusset comprising a series of four overlapping gusset panels extending a height similar to a height of the left side wall and comprising (i) a first left gusset panel foldably connected to the front wall, (ii) a second left gusset panel foldably connected to a front side of the left side wall, (iii) a third left gusset panel foldably connected to a rear side of the left side wall, and (iv) a fourth gusset panel foldably connected a left side to the back wall;

(h) the right hand side gusset comprising a series of four overlapping gusset panels extending a height similar to a height of the right side wall and comprising (i) a first right gusset panel foldably connected to the front wall, (ii) a second right gusset panel foldably connected to a front side of the right side wall, (iii) a third right gusset panel foldably connected to a rear side of the right side wall, and (iv) a fourth gusset panel foldably connected to a right side of the back wall.

14. The carton of claim 13, wherein the first left gusset panel is folded inwardly and glued to the second left gusset panel and wherein the fourth left gusset panel is folded inwardly and glued to the third left gusset panel.

15. The carton of claim 13, wherein the second left gusset panel is folded outwardly with the first left gusset panel wrapping thereover and glued to an outer side of the left side wall and wherein the third left gusset panel is folded outwardly with the fourth left gusset panel wrapping thereover and being glued to an outer side of the left side wall.

16. The carton of claim 13, wherein the front wall makes a generally perpendicular angle with the base and the back wall has a slightly outward angle from perpendicular with respect to the base.

17. The carton of claim 13, wherein front wall and the back wall are tapered and provide an upward and outward taper from the base of the carton to the lid.

18. A carton formed from a one-piece blank, comprising:

(a) a front wall, (b) a left side wall, (c) a right side wall;

(d) a back wall;

(e) a base; and (f) a lid comprising left and right side flaps, each side flap foldably connected to first and second side wrap/glue panels, wherein the left side wall is reinforced by a left-hand side gusset and wherein the right side wall is reinforced by a right-hand side gusset;

(g) the left hand side gusset comprising a series of four overlapping gusset panels extending a height similar to a height of the left side wall and comprising (i) a first left gusset panel foldably connected to the front wall, (ii) a second left gusset panel foldably connected to a front side of the left side wall, (iii) a third left gusset panel foldably connected to a rear side of the left side wall, and (iv) a fourth gusset panel foldably connected a left side to the back wall;

(h) the right hand side gusset comprising a series of four overlapping gusset panels extending a height similar to a height of the right side wall and comprising (i) a first right gusset panel foldably connected to the front wall, (ii) a second right gusset panel foldably connected to a front side of the right side wall, (iii) a third right gusset panel foldably connected to a rear side of the right side wall, and (iv) a fourth gusset panel foldably connected to a right side of the back wall.

* * * * *